US009473860B2

(12) United States Patent
Fischer et al.

(10) Patent No.: US 9,473,860 B2
(45) Date of Patent: Oct. 18, 2016

(54) METHOD AND HEARING AID SYSTEM FOR LOGIC-BASED BINAURAL BEAM-FORMING SYSTEM

(71) Applicant: SIVANTOS PTE. LTD., Singapore (SG)

(72) Inventors: Eghart Fischer, Schwabach (DE); Homayoun Kamkar Parsi, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 102 days.

(21) Appl. No.: 14/279,565

(22) Filed: May 16, 2014

(65) Prior Publication Data

US 2014/0341407 A1 Nov. 20, 2014

(30) Foreign Application Priority Data

May 16, 2013 (DE) ..... 10 2013 209 062

(51) Int. Cl.
*H04R 25/00* (2006.01)
*G10L 21/0216* (2013.01)

(52) U.S. Cl.
CPC ..... *H04R 25/552* (2013.01); *H04R 25/405* (2013.01); *H04R 25/407* (2013.01); *G10L 2021/02166* (2013.01)

(58) Field of Classification Search
CPC .. H04R 25/40; H04R 25/405; H04R 25/407; H04R 25/43; H04R 25/55; H04R 25/552; H04R 2225/61
USPC ..... 381/23.1, 313, 315, 317, 320
See application file for complete search history.

(56) References Cited

U.S. PATENT DOCUMENTS

| | | | |
|---|---|---|---|
| 6,983,055 | B2 | 1/2006 | Luo |
| 8,660,281 | B2 | 2/2014 | Bouchard et al. |
| 2004/0196994 | A1 | 10/2004 | Kates |
| 2009/0022344 | A1 | 1/2009 | Hain et al. |

(Continued)

FOREIGN PATENT DOCUMENTS

| | | | |
|---|---|---|---|
| EP | 1326478 | A2 | 7/2003 |
| EP | 2018079 | A1 | 1/2009 |

(Continued)

OTHER PUBLICATIONS

Wittkop, Thomas, et al.: "Strategy-selective noise reduction for binaural digital hearing aids"; Speech Communication vol. 39, 2003, pp. 111-138; Elsevier Science; 39; 0167639302; 2003.

(Continued)

*Primary Examiner* — Ahmad F. Matar
*Assistant Examiner* — Sabrina Diaz
(74) *Attorney, Agent, or Firm* — Laurence A. Greenberg; Werner H. Stemer; Ralph E. Locher

(57) ABSTRACT

A method for beam-forming for a hearing aid system is disclosed. The hearing aid system has a left and a right hearing aid device for disposal on a head of a wearer. The hearing aid devices each have microphones for converting the sound into a left and a right input signal and also a signal processing device which receives the two input signals. In the method a number of different linear combinations of the left and the right input signal are provided, are assessed according to a predetermined signal criterion and, in dependence thereof, one of the linear combinations is selected as a beam signal.

12 Claims, 4 Drawing Sheets

(56) References Cited

U.S. PATENT DOCUMENTS

2009/0304203 A1* 12/2009 Haykin ..... G10L 21/02 381/94.1
2010/0303267 A1* 12/2010 Pedersen ..... H04R 25/407 381/313

FOREIGN PATENT DOCUMENTS

EP 2262285 A1 12/2010
WO 2010091077 A1 8/2010

OTHER PUBLICATIONS

Van Den Bogaert, Tim, etal.: "Binaural cue preservation for hearing aids using an interaural transfer function multichannel Wiener filter",pp. IV 565-IV568, IEEE 2007; 2007.

Klasen, Thomas J., et.al.: "Binaural Noise Reduction Algorithms for Hearing Aids That Preserve Interaural Time Delay Cues", IEEE Transactions on Signal Processing , vol. 55, No. 4, pp. 1579-1585, Apr. 2007; 2007.

Lotter, Thomas, et al.: "Dual-Channel Speech Enhancement by Superdirective Beamforming", Eurasip Journal on Applied Signal Processing, pp. 1-14, vol. 2006; 2005.

Kamkar-Parsi, Homayoun, et al: "Instantaneous Binaural Target PSD Estimation for Hearing Aid Noise Reduction in Complex Acoustic Environments"; IEEE Transactions on Instrumentation and Measurement, vol. 60, No. 4, April 2011, pp. 1141-1154; 2011.

Klasen T. J. et al.: "Binaural multi-channel Wiener filtering for hearing aids: Preserving interaural time and level differences"; in Proc. IEEE ICASSP, May 2006, vol. 5, pp. 145 -148.; 2006.

Doclo, S, et al., "Extension of the multi-channel Wiener filter with ITD cues for noise reduction in binaural hearing aids"; in Proc. IEEE Workshop on Applications of Signal Processing to Audio and Acoustics, Oct. 2005, pp. 70-73.; 2005.

* cited by examiner

METHOD AND HEARING AID SYSTEM FOR LOGIC-BASED BINAURAL BEAM-FORMING SYSTEM

CROSS-REFERENCE TO RELATED APPLICATION

This application claims the priority, under 35 U.S.C. §119, of German application DE 10 2013 209 062.5, filed May 16, 2013; the prior application is herewith incorporated by reference in its entirety.

BACKGROUND OF THE INVENTION

Field of the Invention

The present invention relates to a hearing aid system, wherein the hearing aid system has a left and a right hearing aid. The left hearing aid has a left acousto-electric converter and the right hearing aid has a right acousto-electric converter. The converters are configured to convert incoming acoustic signals into left and right electrical signals. Furthermore the hearing aid system has a signal processing device, wherein the signal processing device is connected for signaling purposes to the left and the right acousto-electric converters.

Hearing aids are wearable hearing devices serving to aid persons with impaired hearing. In order to meet the numerous individual requirements, different forms of hearing aids such as behind-the-ear (BTE) hearing aids, hearing aids with external earpieces (RIC: receiver in the canal) and in-the-ear hearing aids (ITE), e.g. also Concha hearing aids or in-canal hearing aids (CIC), are provided. The hearing aids given by way of example are worn on the outer ear or in the auditory canal. In addition there are also bone-conduction hearing aids, implantable or vibrotactile hearing aids available on the market. In such cases the damaged hearing is stimulated either mechanically or electrically.

In principle hearing aids possess an input transducer, an amplifier and an output transducer as their major components. The input transducer is generally an acousto-electric converter, e.g. a microphone and/or an electromagnetic receiver, e.g. an induction coil. The output transducer is mainly implemented as an electro-acoustic converter, e.g. miniature loudspeaker or as an electro-mechanical converter, e.g. bone conduction earpiece. The amplifier is usually integrated into a signal processing unit.

It is known that hearing with two ears makes it easier for a person to understand speech in interference noise or in a distorted environment. In addition binaural hearing is an important requirement for spatial hearing and sound wave localization. Because of the importance of the binaural processes in the analysis of hearing situations it is understandable that hearing-impaired persons profit more from two hearing devices for a binaural supply than from a single hearing device for a monaural supply.

In such cases binaural signal processing is also used to filter out interference noise. U.S. patent publication No. 2004/0196994 A1 thus describes the use of Wiener filters to filter out uncorrelated interference noise for example.

The use of adaptive filters in binaural signal processing to filter out interference noise is also known from U.S. Pat. No. 6,983,055 B2.

An embodiment of a static directional characteristic by means of static beam-forming from binaural signals is not capable of reacting independently to changed acoustic environments, so that the wearer of the hearing aid device must react themselves through adjustments on the device.

Adaptive filters in their turn are based on the specific requirements for the useful signals and noise signals, so that, in specific hearing situations which do not meet these requirements, the comprehensibility for the wearer can even be worsened by the adaptive filters and the wearer must once again make manual corrections.

An estimation of the spectral energy density of a useful signal is known for example from international patent disclosure WO 2010/091077, corresponding to U.S. Pat. No. 8,660,281.

SUMMARY OF THE INVENTION

It is therefore the object of the present invention to provide a hearing aid system and a method for operating the hearing aid system which avoids the above-mentioned disadvantages and gives the wearer an improved hearing response with simplified operation.

The inventive method relates to a method for beam-forming for hearing aid systems. The hearing aid system has a left and a right hearing aid device for disposal on a head of the wearer. Usually the hearing aid devices are worn on or in the left or right ear. The left hearing aid device has a left acousto-electric converter which converts sound waves arriving at the left hearing aid device into a left input signal. The right hearing aid device has a right acousto-electric converter which converts sound waves arriving at the right hearing aid into a right input signal. The hearing aid system also has a signal processing device which is connected for signaling purposes to the left and the right acousto-electric converters and receives the left and the right input signal.

In a step of the inventive method a number of different linear combinations of the left input signal and the right input signal are provided.

In a further step the linear combinations are assessed in accordance with a predetermined signal criterion.

In a further step a linear combination is selected as a beam signal as a function of the assessment.

It is advantageous in this case for the linear combinations to be simple-to-compute and therefore to require a low processing power. Furthermore the linear combinations are undistorted signals without artificial frequency components and provide a natural hearing impression. By the linear combinations being assessed and one being selected as a beam signal, the beam forming is able to be predicted in a deterministic way through the type of assessment of the output signal and no undesired effects are to be expected.

Further advantageous developments of the invention are specified in the dependent claims.

In a preferred form of embodiment of the method the input signals are weighted with a weighting factor during the provision of the linear combinations, wherein the sum of the weighting factors of a linear combination is equal to 1 in each case.

Since with hearing aid devices worn on the head, because of the symmetry for sound sources directly in front of the wearer, the left and the right input signal are the same strength in each case, therefore an equally strong summation signal is advantageously produced for all linear combinations for the source in front of the wearer.

In a possible form of embodiment of the method the linear combinations are assessed by defining a signal level of the linear combinations.

In an advantageous manner the energy content of the respective linear combination can be deduced by the signal level.

In a form of embodiment of the method a linear combination selection is made by selecting the linear combination with the lowest signal level.

In this case it is of advantage that the signal with the lowest energy content is selected in this way. In particular in conjunction with the feature that the sum of the linear coefficients is equal to 1, because of the constant level of the signal of the source in front of the wearer the advantageous effect is produced that in this way the signal with the lowest level of interference noise from directions not the same as the direction in front of the wearer is selected.

In a form of embodiment of the method an estimated value for the spectral power density of a useful signal and of an interference noise signal is determined from the left and the right input signal and the beam signal is amplified or attenuated as a function thereof.

Thus in an advantageous way, by contrast with adaptive filters, it is even possible to recognize the useful signal and amplify it for example with a factor greater than 1, through which the signal-to-noise ratio is further improved. Conversely, if the situation is recognized that just interference noise is present, the noise can be attenuated.

In a form of embodiment of the method the steps of the method are each executed separately for a plurality of frequency ranges.

This advantageously makes it possible to distinguish noise sources with different frequencies and suppress them in the optimum manner in the respective frequency band for example.

In a possible form of embodiment of the method a linear combination is selected by switching over or cross-fading the beam signal between two linear combinations.

In an advantageous manner the switch over to the signal with the respective lowest interference noise component occurs automatically for the user. With a cross-fade in particular the transition is barely perceptible for the user.

The described advantages are likewise produced for the inventive hearing aid system for executing the method.

Other features which are considered as characteristic for the invention are set forth in the appended claims.

Although the invention is illustrated and described herein as embodied in a method and a hearing aid system for logic-based binaural beam-forming system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
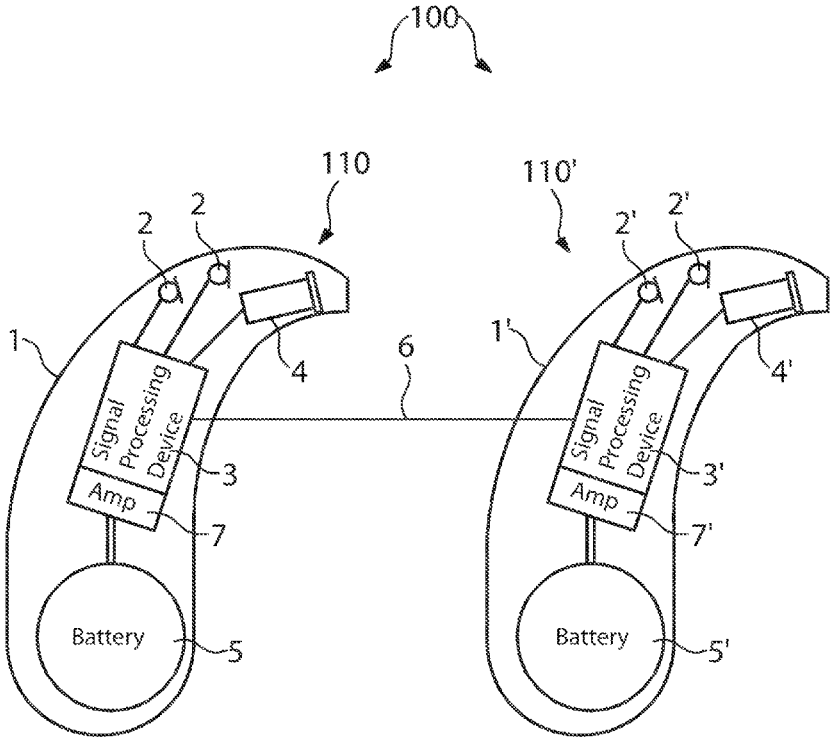
FIG. 1 is a schematic diagram of a hearing aid system according to the invention.

Referring now to the figures of the drawings in detail and first, particularly to FIG. 1 thereof, there is shown a principal structure of an inventive hearing aid system 100. The hearing aid system 100 has two hearing aid devices 110, 110'. Built into a hearing aid housing 1, 1' for wearing behind the ear are one or more microphones 2, 2' for picking up the sound or acoustic signals from the environment. The microphones 2, 2' are acousto-electric converters 2, 2' for converting the sound into first audio signals. A signal processing device 3, 3', which is likewise integrated into the hearing aid housing 1, 1', processes the first audio signals. The output signal of the signal processing device 3, 3' is transmitted to a loudspeaker or earpiece 4, 4', which outputs an acoustic signal. If necessary the sound is transmitted via a sound tube which is fixed with an otoplastic into the auditory canal, to the eardrum of the device wearer. The hearing device and especially the signal processing device 3, 3' are supplied with energy by a battery 5, 5', likewise integrated into the hearing device housing 1, 1'.

Furthermore the hearing aid system 100 has a signal, connection 6, which is configured to transmit a left input signal from the signal processing device 3 to the signal processing device 3'. Conversely there is provision for the signal processing device 3' to also transmit a right input signal to the signal processing device 3 in the opposite direction for example.

The signal connection 6 can be made galvanically. In a preferred form of embodiment however the first and second electrical signals are converted for transmission via the signal connection. The signal connection can thus for example be made inductively, via Bluetooth, optically or using another wireless transmission technology.

Furthermore it is conceivable to transmit the signals of a number of microphones or all microphones 2, 2' to the other hearing aid device 110, 110' in each case.

The signal processing device 3, 3' is configured to form a number of linear combinations from the left and right input signal, to assess the linear combinations and, on the basis of the assessment, to select one of the linear combinations as the beam signal. Further details are to be found in the description of the method steps given below for FIG. 2.

In the preferred embodiment the hearing aid system 100 also has a device 7, 7' for adjusting the amplification of the beam signal.

The signal processing device 3, 3' and the device 7, 7' for adjusting the amplification of the beam signal can, as shown in FIG. 1, be an integral component of the signal processing device 3, 3'. It is however also conceivable for the device 7, 7' for detecting a single voice to be embodied as a separate device in the hearing aid device 110, 110'.

Basically, as shown in FIG. 1, each hearing aid device can have a separate signal processing device 3, 3' and can be supplied with the signals of both microphones 2, 2'. Each of the signal processing devices 3, 3' is then independently capable of determining the signal differences between the microphones 2, 2' and compensating for the differences. It is however also conceivable for only one of the hearing aid devices 110, 110' to have a signal processing device 3, 3' which carries out the signal processing, the determination and the compensation and forwards the resulting signal via the signal connection 6 to the other hearing aid device 110, 110' for output. The same applies to the device 7, 7' for setting the amplification of the beam signal, which is either provided for example in each case in each of the hearing aid devices 110, 110' or also only in one device jointly for both hearing aid devices 110, 110'.

Figure 2:
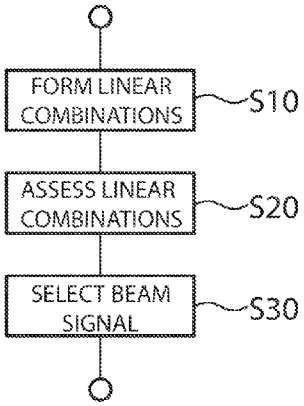
FIG. 2 is a flow chart illustrating a method for operating the hearing aid system according to the invention.

FIG. 2 shows a schematic flow diagram of an inventive method in the signal processing device 3, 3'.

The method has a step S10 for provision of a number of linear combinations of the left input signal and of the right input signal. This step includes inter alia the conversion of an acoustic signal at the microphones 2, 2' into a left input signal LS and a right input signal RS, as well as its transmission to the signal processing device 3, 3'. The signal processing device 3, 3' provides a number of linear combinations LKi of the input signals LS and RS. For example linear combinations LK1, LK2 can be formed with coefficients fli, fri as follows:

$$LK1=fl1*LS+fr1*RS;$$

$$LK2=fl2*LS+fr2*RS; \text{ and}$$

$$LK3=fl3*LS+fr3*RS.$$

In a preferred form of embodiment the sum of the coefficients of a linear combination in this case is equal to 1:

$$fl1+fr1=1; fl2+fr2=1; fl3+fr3=1.$$

For example the following coefficients fulfill this condition:

$$fl1=0.25 \text{ and } fr2=0.75;$$

$$fl2=0.5 \text{ and } fr2=0.5; \text{ and}$$

$$fl3=0.75 \text{ and } fr3=0.25.$$

Because of the symmetry of the head, precisely for signals which have their origin in the direction directly in front of the wearer of the hearing aid devices in the plane of symmetry of the head, the proportion in the sum of the linear combination for each linear combination with this boundary condition is always equally large.

In this case there is provision for the coefficients to be predetermined. However it is also conceivable for the coefficients to be determined as part of the method.

Naturally it is also conceivable that more than two input signals will be combined. Thus for example each of the hearing aid devices can have two microphones 2, 2', so that a linear combination will be formed in each case from 4 signals. In such cases, in the preferred form of embodiment, the boundary condition is maintained that the sum of the coefficients, in this case four coefficients, is equal to 1 in each case. Equally conceivable are three or more input signals and coefficients per side in each case.

In a step S20 the linear combinations from step S10 are assessed. In a preferred manner this is also done by the signal processing device 3, 3'. A possible assessment of the linear combination is a determination of a momentary signal level by means of a fast signal meter. This can for example be done by a short-term averaging of the amount of the linear combination, wherein the short-term averaging could include a few periods of the signal in each case. It is however also conceivable for example to use the maximum of the amount of the amplitude of the signal in one signal period in each case for determining the signal level.

In a step S30 in this case one of the linear combinations is selected as a beam signal on the basis of the assessment. In the preferred exemplary embodiment in such cases the linear combination is selected for which the signal level determined as assessment criterion is lowest. The energy density of the signal in this case is correlated with the square of the signal level. As already mentioned previously, for all linear combinations, under the boundary condition of the sum of the coefficients is equal to 1, the signal level of a source from the plane of symmetry of the head is the same. Thus the linear combination with the lowest signal level and the corresponding lowest energy density is also the linear combination having the lowest proportion of interference noise.

Figure 3:
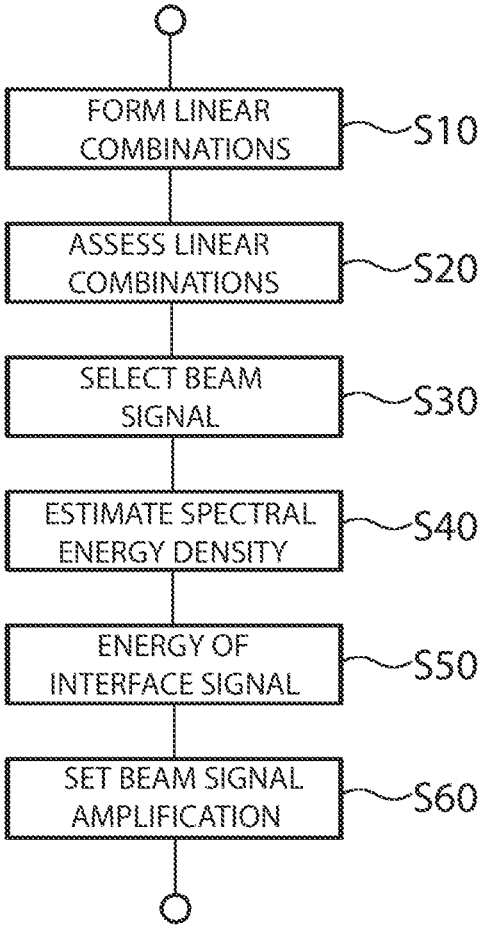
FIG. 3 is a flow chart of a further method for operating the hearing aid system according to the invention.

FIG. 3 presents a flow diagram of a further inventive method. In the steps S10 to S30 the method is identical to the method presented in FIG. 2.

The method of FIG. 3 also has a step S40. In step S40 an estimation of the spectral energy density of the useful signal is carried out.

In step S50, in the same way, an estimation of the spectral energy of the interference signals is carried out.

In a further step S60, in dependence on the estimated energy densities of the useful signals and the interference signals, the amplification of the beam signal is set. If it is estimated that the energy density of the useful signal is small, i.e. no useful signal is arriving from a source in the plane of symmetry, the amplification of the beam signal is reduced and thus also the interference signals. If conversely it is estimated that the energy density of the useful signal is large and thus that a useful signal is present, the amplification of the beam signal can be increased. By contrast with adaptive filters, which in the best case let the useful signal pass through them practically without attenuation, with the inventive method an amplification of the useful signal with a factor greater than one is also possible, so that the signal-to-noise ratio can be improved compared to an adaptive filter.

In a possible form of embodiment the linear combination is selected in step S60 by a switchover or cross-fading of the beam signal between the previously selected linear combination and the linear combination selected as from the switchover point. In the switchover the signal connection between the beam signal output and the linear combination is changed from the previous linear combination to the newly selected combination. In digital signal processing this is done for example by the signal processing device 3, 3' passing the result of the selected linear combination to the beam signal output as from this point in time. For cross-fading for example the sum of the previous and the selected linear combination can be passed on, wherein the previous linear combination is weighted with a factor falling over time to zero and the selected linear combination is weighted with a factor increasing over time to one.

With hearing aid devices it is normal for the signals to be processed as a function of frequency to enable frequency-dependent hearing losses to be suitably compensated for. The steps S10 to S30 or S10 to S60 are thus likewise executed in a possible form of embodiment separately for individual frequency ranges or frequency bands of the input signals, so that in each frequency range the beam signal with the lowest interference noise proportion can be selected.

Figure 4:
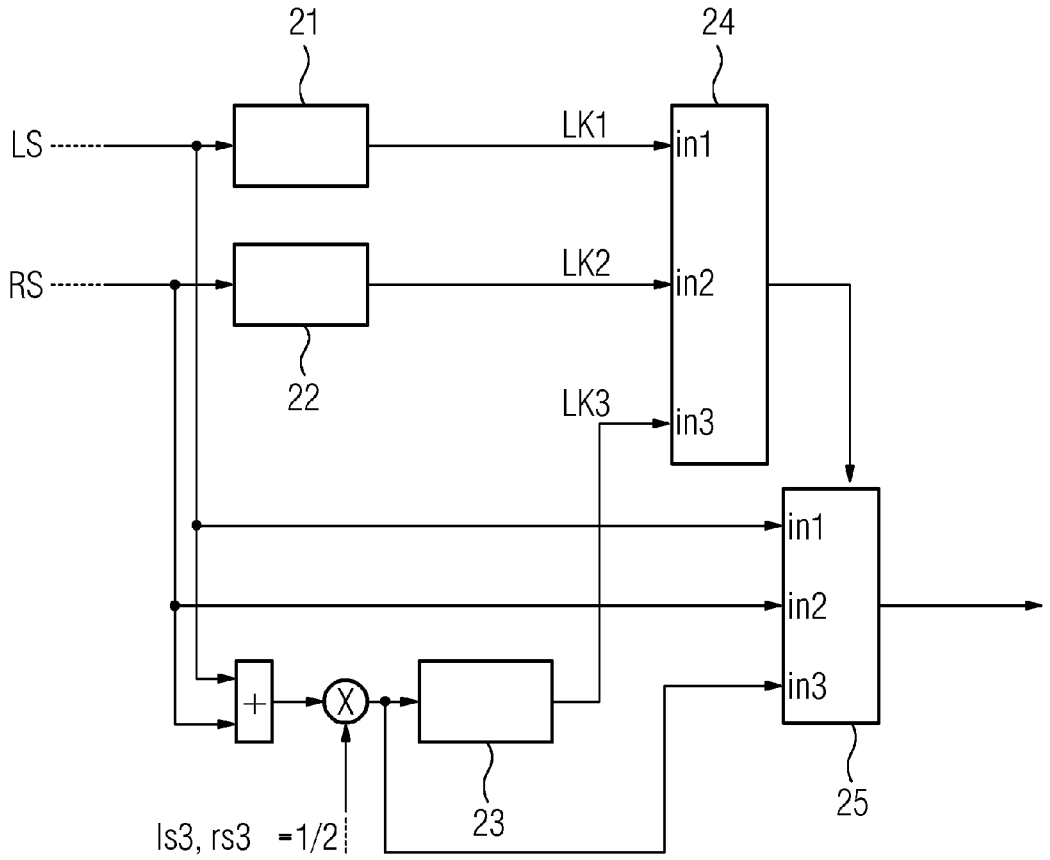
FIG. 4 is a block diagram showing a depiction of parts of a hearing aid device.

FIG. 4 shows the sequence of FIG. 2 presented in function blocks. The signals LS and RS are provided as 3 linear combinations LK1, LK2 and LK3 with the coefficients Is1=1 and rs1=0, Is2=0 and rs2=1 as well as Is3=0.5 and rs3=0.5 in accordance with step S10. In the level meters 21, 22, 23 and the comparator 24 the linear combinations LK1, LK2 and LK 3 are assessed in accordance with step S20. The comparator 24 decides on the basis of the criterion of the minimal level which is to be selected and passes this information on to the switch 25. This selects in step S30 from the linear combinations LK1, LK2, LK3 that combination which is to be passed on as the beam signal.

Figure 5:
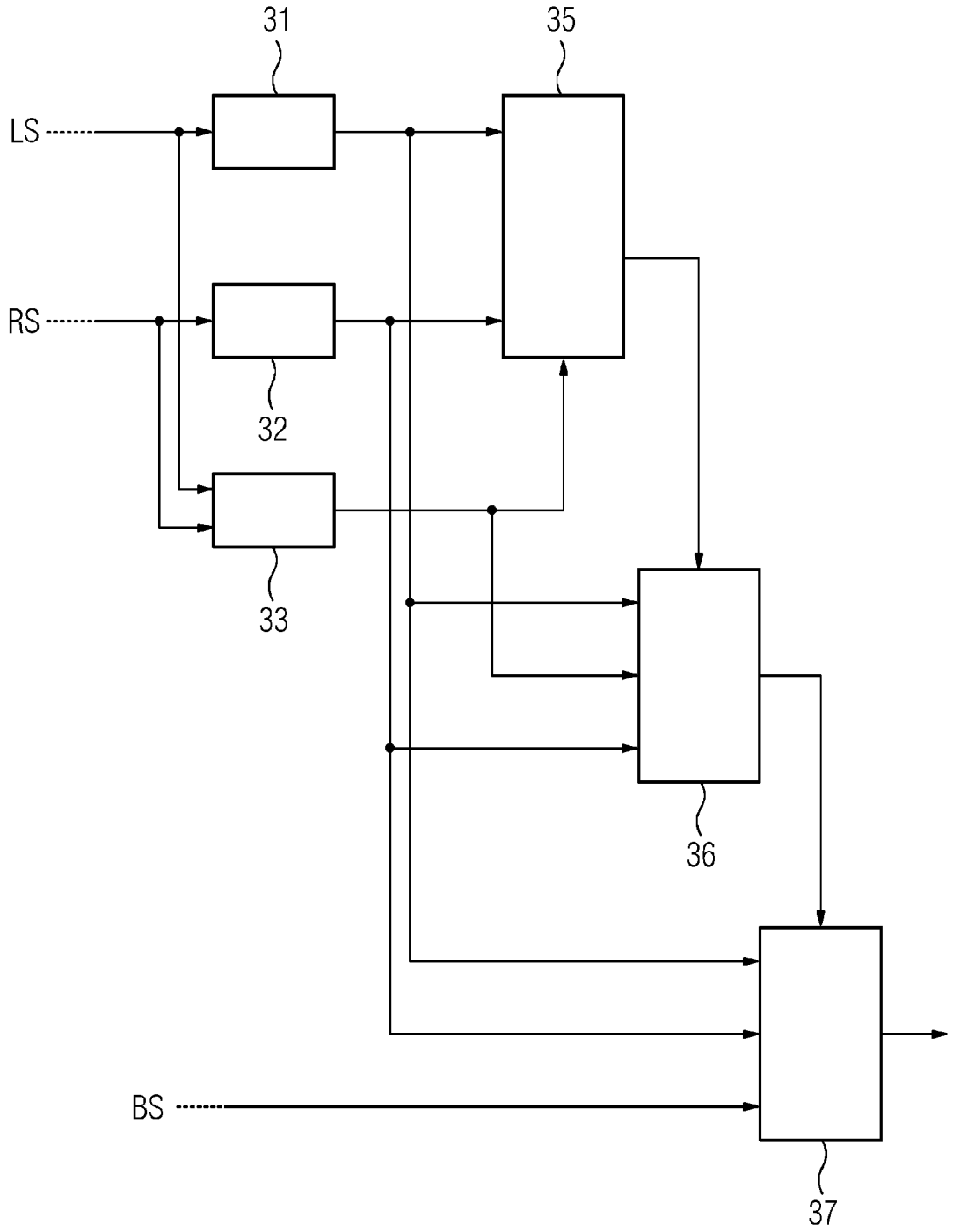
FIG. 5 is a block diagram showing the depiction of parts the hearing aid device.

In FIG. 5 the sequence of steps S40 to S60 is presented in function blocks. In the filter blocks 31, 32 and 33 there is a pre-filtering and smoothing of the signals LS and RS. The estimation block 35 performs an estimation of the spectral energy density of the useful signal with the pre-filtered signals in accordance with step S40. In estimation block 36 in the same way according to step S50 an estimation of the spectral energy density of the noise signal is performed. In adjustment block 37 the pre-filtered beam signal BS is amplified according to step S60.

Although the invention has been illustrated and described in greater detail by the preferred exemplary embodiment, the invention is not limited by the disclosed examples and other variations can be derived there from by the person skilled in the art, without departing from the scope of protection of the invention.

The invention claimed is:

1. A method for beam-forming for hearing aid systems, wherein a hearing aid system has a left hearing aid device and a right hearing aid device disposed on a head of a wearer, the left hearing aid device having a left acousto-electric converter converting sound waves arriving at the left hearing aid device into a left input signal and the right hearing aid device having a right acousto-electric converter converting sound waves arriving at the right hearing aid device into a right input signal, the hearing aid system further having a signal processing device connected for signaling purposes to the left and the right acousto-electric converters and receiving the left and the right input signals, which comprises the steps of:

providing a number of different linear combinations of the left input signal and the right input signal;

assessing the linear combinations in accordance with a predetermined signal criterion; and selecting one of the linear combinations as a beam signal in dependence on an assessment, namely selecting a linear combination by selecting the linear combination with a lowest signal level.

2. The method according to claim 1, which further comprises during the providing of the linear combinations, weighting the left and right input signals with weighting factors and a sum of the weighting factors of a linear combination is equal to 1 in each case.

3. The method according to claim 1, wherein the assessment of the linear combinations further comprises determining a signal level of the linear combinations.

4. The method according to claim 1, which further comprises:

determining an estimated value from the left and the right input signals for a spectral power density of a useful signal and an interference noise signal; and amplifying or attenuating the beam signal in dependence on the estimated value.

5. The method according to claim 1, which further comprises carrying out the steps of the method each separately for a plurality of frequency ranges.

6. The method according to claim 1, wherein the selection of the linear combination includes the step of switching over or cross-fading of the beam signal between two linear combinations.

7. A hearing aid system, comprising:

hearing devices including a left hearing aid device and a right hearing aid device for disposal on a head of a wearer in accordance with usage, said left hearing aid device having a left acousto-electric converter converting sound waves arriving at said left hearing aid device into a left input signal and said right hearing aid device having a right acousto-electric converter converting sound waves arriving at said right hearing aid device into a right input signal;

a signal processing device connected for signaling purposes to said left and said right acousto-electric converters and receiving the left and the right input signals;

the hearing aid system configured to:

provide a number of different linear combinations of the left input signal and of the right input signal;

assess the linear combinations in accordance with a predetermined signal criterion; and select a linear combination as a beam signal in dependence on an assessment, namely by selecting the linear combination with a lowest signal level.

8. The hearing aid system according to claim 7, wherein the hearing aid system is configured to weight the first and second input signals with weighting factors in the linear combinations, wherein a sum of the weighting factors of a linear combination is equal to 1 in each case.

9. The hearing aid system according to claim 7, wherein the hearing aid system determines a signal level of the linear combinations.

10. The hearing aid system according to claim 7, wherein the hearing aid system determines an estimated value for a spectral power density of a useful signal and an interference noise signal from the left and the right input signals and amplifies or attenuates the beam signal in dependence on the estimated value.

11. The hearing aid system according to claim 7, wherein the hearing aid system carries out the steps of the method separately for a plurality of frequency ranges in each case.

12. The hearing aid system according to claim 7, wherein the hearing aid system carries out a selection of the linear combination by a switchover or a cross-fading of the beam signal between two linear combinations.

* * * * *